US006641354B1

(12) United States Patent
Lubrano

(10) Patent No.: US 6,641,354 B1
(45) Date of Patent: Nov. 4, 2003

(54) WHEELCHAIR LIFTING APPARATUS

(76) Inventor: Leonora Lubrano, 11344 Rainbow Woods Loop, Spring Hill, FL (US) 34609

( * ) Notice: Subject to any disclaimer, the term of this patent is extended or adjusted under 35 U.S.C. 154(b) by 0 days.

(21) Appl. No.: 10/046,608

(22) Filed: Jan. 16, 2002

(51) Int. Cl.[7] ..... A61G 7/10
(52) U.S. Cl. ..... 414/678; 414/921
(58) Field of Search ..... 414/678, 921; 410/10, 11, 104, 105

(56) References Cited

U.S. PATENT DOCUMENTS 2,024,444 A * 12/1935 Frieplaender ..... 410/10
4,759,684 A * 7/1988 Lanzillotta et al. ..... 414/678
4,805,954 A * 2/1989 Lazaroff ..... 296/65.1
5,026,225 A * 6/1991 McIntyre ..... 410/23
5,520,363 A * 5/1996 Burton et al. ..... 248/430
5,651,149 A * 7/1997 Garman ..... 5/81.1 R
5,707,188 A * 1/1998 Longstreet ..... 410/96

FOREIGN PATENT DOCUMENTS

DE 4242348 * 6/1994

* cited by examiner

*Primary Examiner*—Steven A. Bratlie

(57) ABSTRACT

A wheelchair lifting apparatus for raising, lowering, and tilting a wheelchair to allow a hairdresser to work on a person's hair while sitting in a wheelchair. The wheelchair lifting apparatus includes a base member for resting upon a floor; and also includes a lift assembly being mounted upon the base member and including hydraulic members, and also including a lift lever being movably disposed in the base member for moving the hydraulic members vertically, and further including a tilt lever being movably disposed in the base member for independently moving the hydraulic members vertically; and further including a bracket assembly being mounted upon the hydraulic members for fastening a wheelchair to the hydraulic members.

8 Claims, 3 Drawing Sheets

WHEELCHAIR LIFTING APPARATUS

BACKGROUND OF THE INVENTION

1 Field of the Invention

The present invention relates to wheelchair lifts and more particularly pertains to a new wheelchair lifting apparatus for raising, lowering, and tilting a wheelchair to allow a hairdresser to work on a person's hair while sitting in a wheelchair.

2 Description of the Prior Art

The use of wheelchair lifts is known in the prior art. More specifically, wheelchair lifts heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,941,799; U.S. Pat. No. 4,592,695; U.S. Pat. No. 5,040,939; U.S. Pat. No. Des. 306,843; U.S. Pat. No. 6,015,256; and U.S. Pat. No. 4,830,567.

While these devices fulfill their respective, particular objectives and requirements, the aforementioned patents do not disclose a new wheelchair lifting apparatus. The inventive device includes a base member for resting upon a floor; and also includes a lift assembly being mounted upon the base member and including hydraulic members, and also including a lift lever being movably disposed in the base member for moving the hydraulic members vertically, and further including a tilt lever being movably disposed in the base member for independently moving the hydraulic members vertically; and further including a bracket assembly being mounted upon the hydraulic members for fastening a wheelchair to the hydraulic members, all features not described nor disclosed by the prior art.

In these respects, the wheelchair lifting apparatus according to the present invention substantially departs from the conventional concepts and designs of the prior art, and in so doing provides an apparatus primarily developed for the purpose of raising, lowering, and tilting a wheelchair to allow a hairdresser to work on a person's hair while sitting in a wheelchair.

SUMMARY OF THE INVENTION

The general purpose of the present invention, which will be described subsequently in greater detail, is to provide a new wheelchair lifting apparatus apparatus and method which has many of the advantages of the wheelchair lifts mentioned heretofore and many novel features that result in a new wheelchair lifting apparatus which is not anticipated, rendered obvious, suggested, or even implied by any of the prior art wheelchair lifts, either alone or in any combination thereof.

There has thus been outlined, rather broadly, the more important features of the wheelchair lifting apparatus in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new wheelchair lifting apparatus apparatus and method which has many of the advantages of the wheelchair lifts mentioned heretofore and many novel features that result in a new wheelchair lifting apparatus which is not anticipated, rendered obvious, suggested, or even implied by any of the prior art wheelchair lifts, either alone or in any combination thereof.

Still another object of the present invention is to provide a new wheelchair lifting apparatus for raising, lowering, and tilting a wheelchair to allow a hairdresser to work on a person's hair while sitting in a wheelchair.

Still yet another object of the present invention is to provide a new wheelchair lifting apparatus that allows a person to remain seated in one's own wheelchair while having a hairdresser do one's hair.

Even still another object of the present invention is to provide a new wheelchair lifting apparatus that makes it easy and convenient for the hairdresser to work on a person's hair while the person is seated in the wheelchair.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
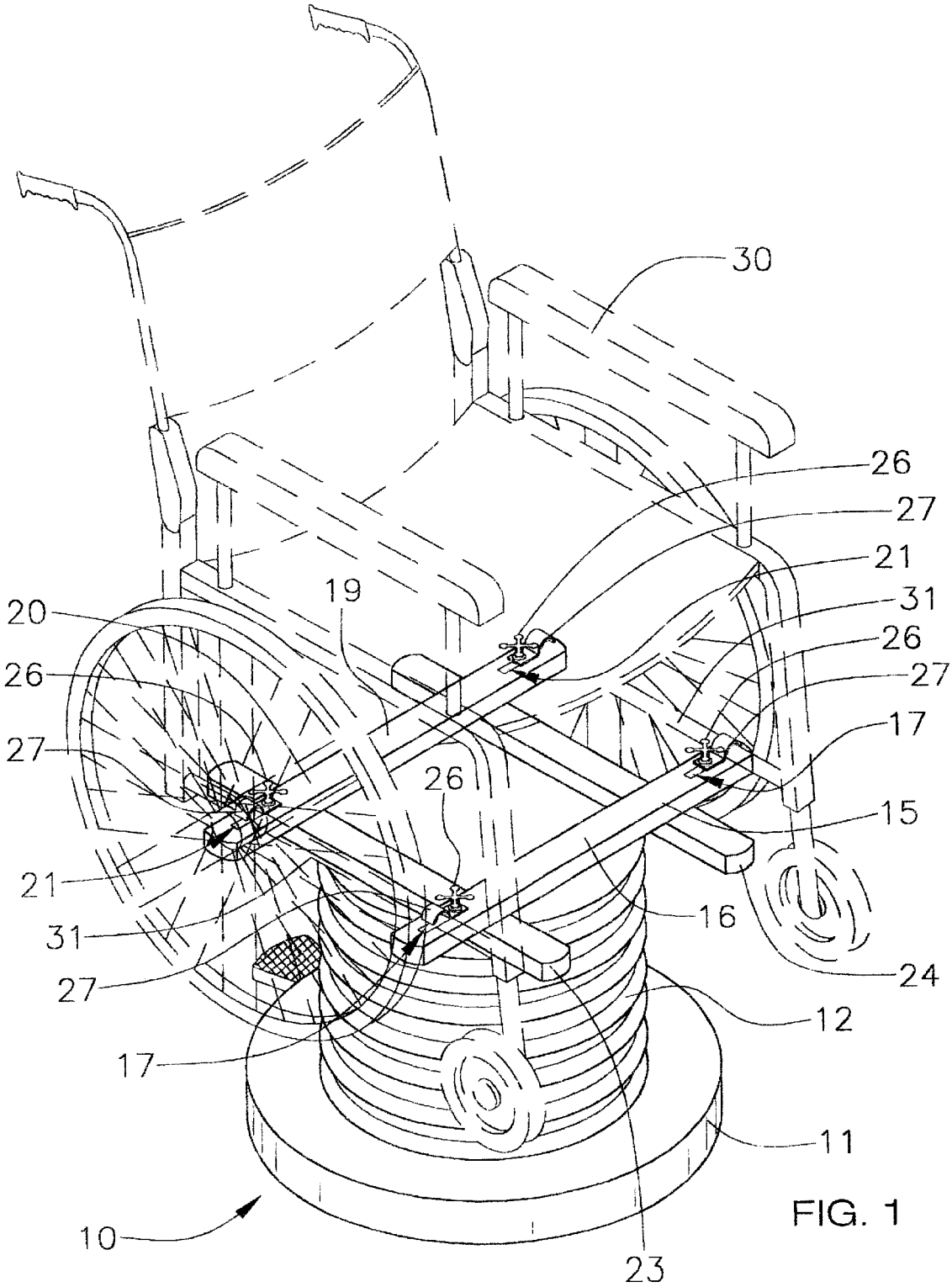
FIG. 1 is a perspective view of a new wheelchair lifting apparatus according to the present invention and shown in use.
Figure 2:
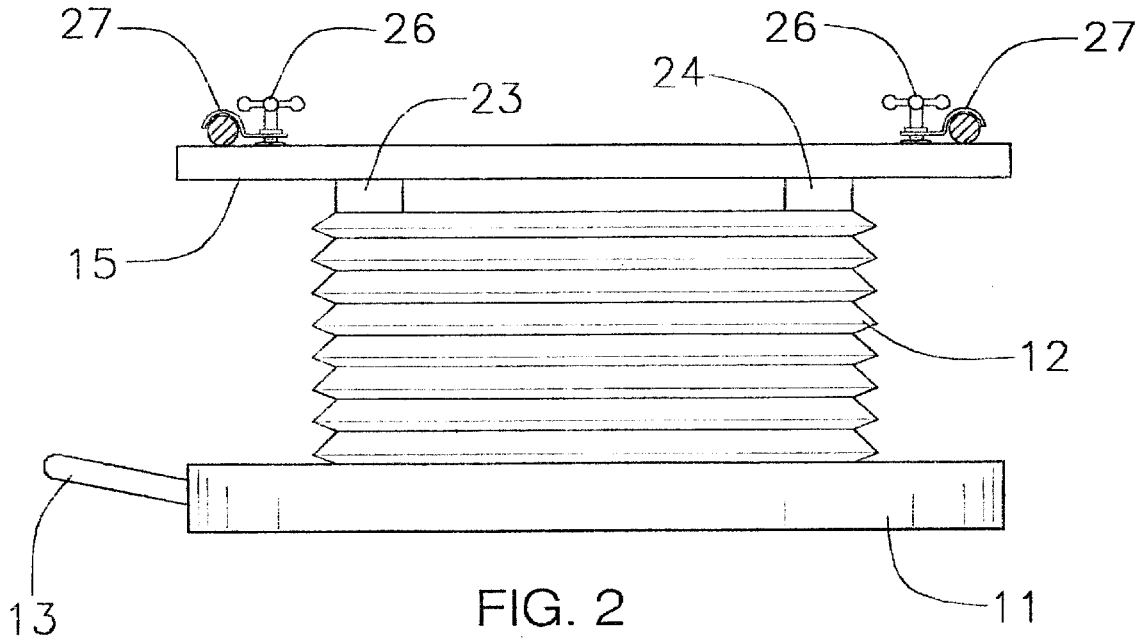
FIG. 2 is a side elevational view of the present invention.
Figure 3:
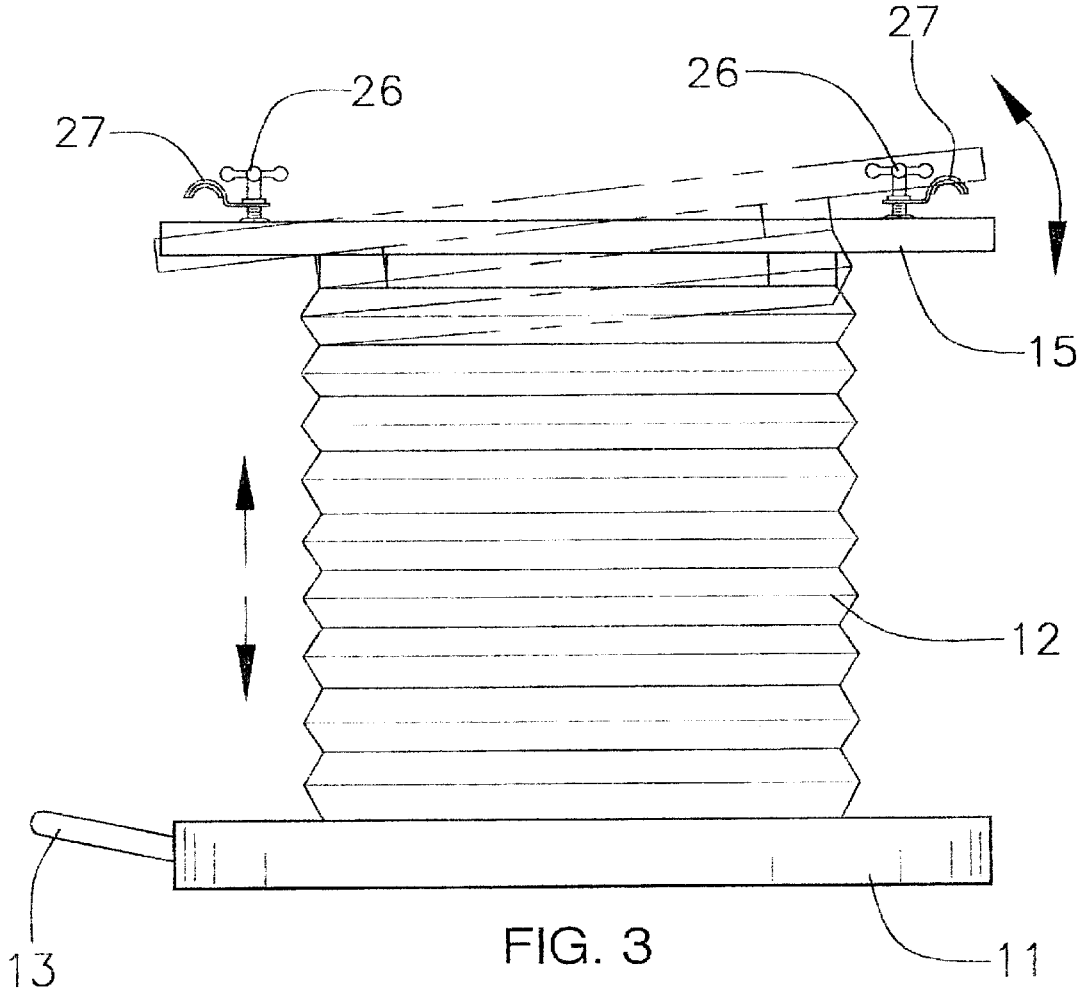
FIG. 3 is another side elevational view of the present invention.
Figure 4:
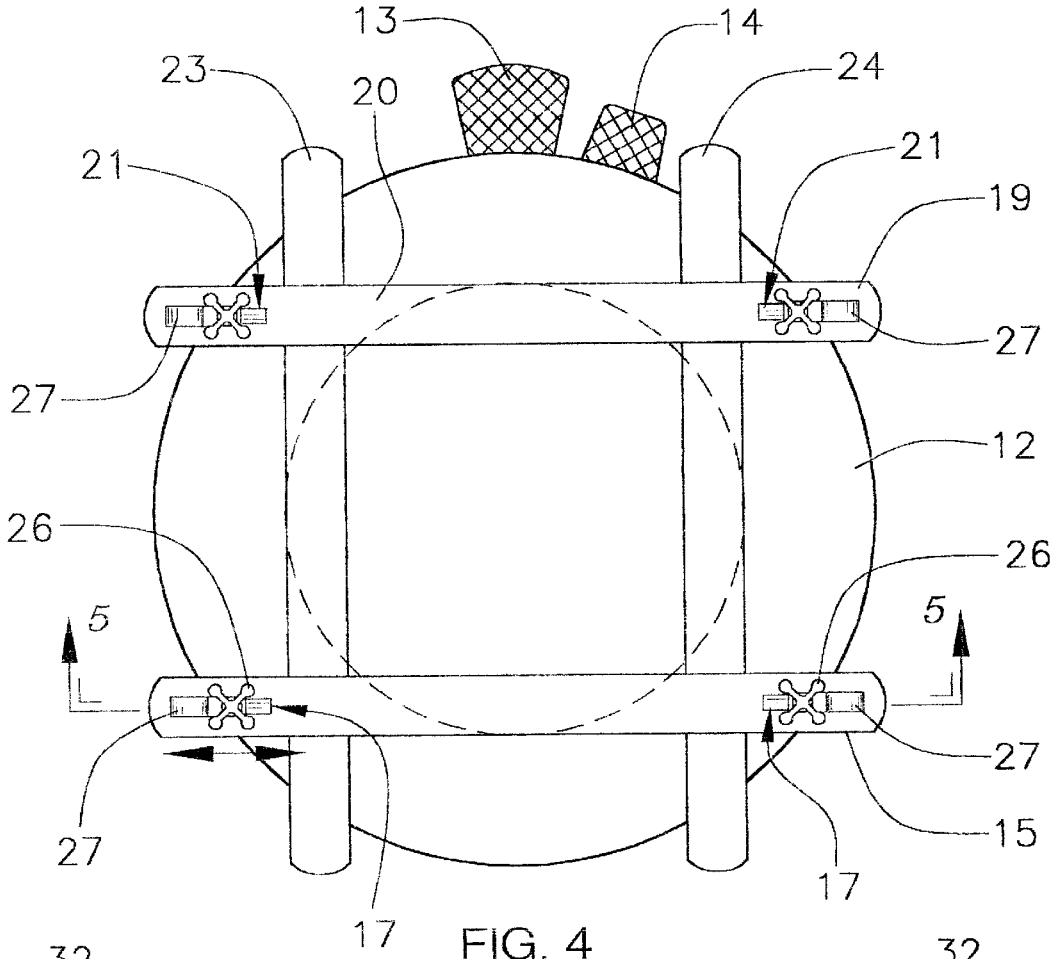
FIG. 4 is a top plan view of the present invention.
Figure 5:
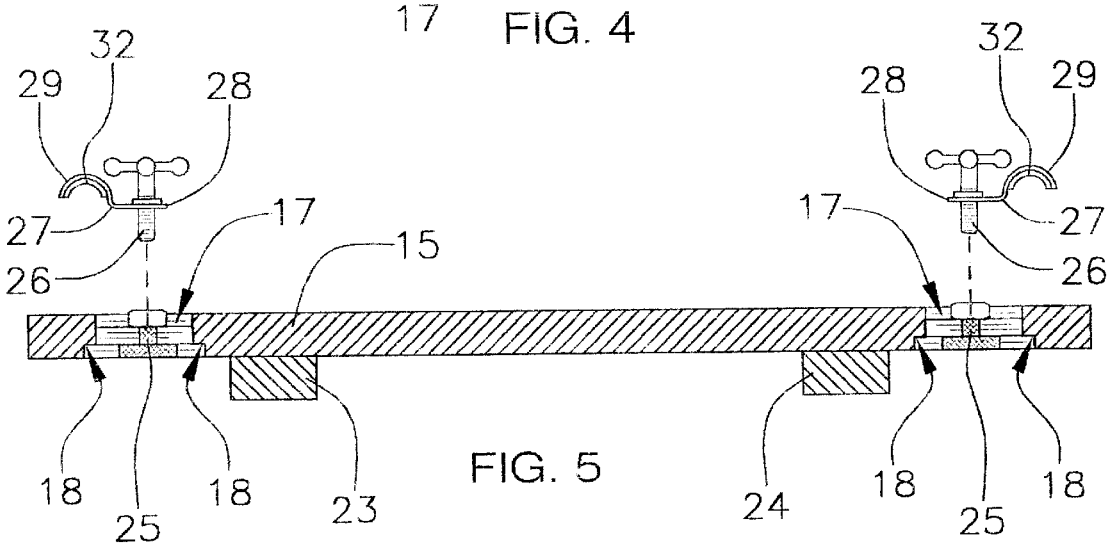
FIG. 5 is a cross-sectional view of the bracket assembly of the present invention.

With reference now to the drawings, and in particular to FIGS. 1 through 5 thereof, a new wheelchair lifting apparatus embodying the principles and concepts of the present invention and generally designated by the reference numeral 10 will be described.

As best illustrated in FIGS. 1 through 5, the wheelchair lifting apparatus 10 generally comprises a conventional base member 11 for resting upon a floor, and also comprises a lift assembly being conventionally mounted upon the base member 11 and including conventional hydraulic members 12, and also including a conventional lift lever 13 being movably and conventionally disposed in the base member 11 for moving the hydraulic members 12 vertically, and further including a. conventional tilt lever 14 being movably and conventionally disposed in the base member 11 for independently moving the hydraulic members 12 vertically.

A bracket assembly is conventionally mounted: upon the hydraulic members 12 for fastening a wheelchair 30, to the hydraulic members 12. The bracket assembly includes a pair of elongate support members 15,19 being spaced apart and being securely and conventionally mounted upon the hydraulic members 12. The bracket assembly further includes a pair of cross members 23,24 being spaced apart and securely interconnecting and bracing the elongate support members 15,19. Each of the elongate support members 15,19 has a top side 16,20 and also has longitudinal slots: 1721 being disposed in the top side 16,20 and near ends thereof. Each of the longitudinal slots 17,21 includes side walls having longitudinal grooves 18 disposed therein near bottoms thereof and defining tracks. The bracket assembly further includes means for clamping the wheelchair 30 upon the elongate support members 15,19. The means for clamping the wheelchair 30 upon the elongate support members 15,19 includes clamping members being adapted to engage a portion of a frame 31 of the wheelchair 30, and also includes fastening members 25,26 supporting the clamping members and being adjustably disposed in the longitudinal slots 17,21. Each of the clamping members is a strip of rigid material 27 having a planar end portion 28 and an arcuate end portion 29 of which in combination with a respective elongate support member 15,19 are adapted to engage a portion of the frame 31 of the wheelchair 30 therebetween. Each of the clamping members also includes a pad member 32 being securely and conventionally attached to the arcuate end portion 29 to prevent scratching of the frame 31 of the wheelchair 30. Each of the fastening members 25,26 includes a threaded receiving member 25 being movably and conventionally disposed in the tracks 18 of a respective longitudinal slot 17,21, and also includes a screw member 26 being disposed through the planar end portion 28 of a respective clamping member and being threaded into the threaded receiving member 25 for engaging a portion of the frame 31 of the wheelchair 30 between the clamping member and a respective elongate support member 15,19.

In use, the user would move the wheelchair 30 upon the elongate support members 15,19 and would clamp the arcuate end portions 29 of the strips of rigid material 27 upon the portions of the frame 31 of the wheelchair 30 to substantially secure the wheelchair 30 upon the hydraulic members 12. Once finished, the user removes the clamping members from the wheelchair 30 and removes the wheelchair 30 from upon the hydraulic members 12.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use; are deemed readily apparent and obvious to one skilled in the art, and all equivalent relationships to those illustrated in the drawings and described in the specification are intended to be encompassed by the present invention.

Therefore, the foregoing is considered as illustrative only of the principles of the wheelchair lifting apparatus. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wheelchair lifting apparatus comprising:

a base member for resting upon a floor;

a lift assembly being mounted upon said base member and including hydraulic members, and also including a lift lever being movably disposed in said base member for moving said hydraulic members vertically, and further including a tilt lever being movably disposed in said base member for independently moving said hydraulic members vertically; and a bracket assembly being mounted upon said hydraulic members for fastening a wheelchair to said hydraulic members, said bracket assembly including a pair of elongate support members being spaced apart and being securely mounted upon said hydraulic members.

2. A wheelchair lifting apparatus as described in claim 1, wherein said bracket assembly further includes a pair of cross members being spaced apart and securely interconnecting and bracing said elongate support members.

3. A wheelchair lifting apparatus as described in claim 1, wherein each of said elongate support members has a top side and also has longitudinal slot being disposed in said top side and near ends thereof.

4. A wheelchair lifting apparatus as described in claim 3, wherein each of said longitudinal slots includes side walls having longitudinal grooves disposed therein near bottoms thereof and defining tracks.

5. A wheelchair lifting apparatus as described in claim 4, wherein said bracket assembly further includes means for clamping the wheelchair upon said elongate support members.

6. A wheelchair lifting apparatus as described in claim 5, wherein said means for clamping the wheelchair upon said support members includes clamping members being adapted to engage a portion of a frame of the wheelchair, and also includes fastening members supporting said clamping members and being adjustably disposed in said longitudinal slots.

7. A wheelchair lifting apparatus as described in claim 6, wherein each of said clamping members is a strip of rigid material having a planar end portion and an arcuate end portion of which in combination with a respective said elongate support member are adapted to engage a portion of the frame of the wheelchair therebetween, each of said clamping members also including a pad member being securely and conventionally attached to said arcuate end portion to prevent scratching of the frame of the wheelchair.

8. A wheelchair lifting apparatus as described in claim 7, wherein each of said fastening members includes a threaded receiving longitudinal slot, and also includes a screw member being disposed through said planar end portion of a respective said clamping member and being threaded into said threaded receiving member for engaging a portion of the frame of the wheelchair between said clamping member and a respective said elongate support member.

* * * * *